US006694993B2

(12) United States Patent
Chou

(10) Patent No.: US 6,694,993 B2
(45) Date of Patent: Feb. 24, 2004

(54) COLLAPSIBLE FRAME STRUCTURE OF A SUNSHADE OR PARASOL

(75) Inventor: Shin Chung Chou, Changhua (TW)

(73) Assignee: Tong Yih Plastic Co., Ltd., Changhua (TW)

( * ) Notice: Subject to any disclaimer, the term of this patent is extended or adjusted under 35 U.S.C. 154(b) by 75 days.

(21) Appl. No.: 10/054,987

(22) Filed: Jan. 25, 2002

(65) Prior Publication Data

US 2003/0140955 A1 Jul. 31, 2003

(51) Int. Cl.[7] ..... E04H 15/28
(52) U.S. Cl. ..... 135/98; 135/98
(58) Field of Search ..... 135/98, 20.1, 21, 135/20.3

(56) References Cited

U.S. PATENT DOCUMENTS 3,818,919 A * 6/1974 Schultes et al. ..... 135/25.3
5,161,562 A * 11/1992 Wu ..... 135/20.3
5,505,221 A * 4/1996 Gao ..... 135/20.1
6,401,735 B1 * 6/2002 Chou ..... 135/20.1

* cited by examiner

*Primary Examiner*—Robert Canfield
(74) *Attorney, Agent, or Firm*—Troxell Law Office PLLC

(57) ABSTRACT

An improved collapsible frame structure for use on an outdoor sunshade or parasol which is equipped with a minor extension arm coupled to a main runner of a main mast and a main extension arm in pivotal connection to a top retainer of the main mast at one end and to a lower end of a secondary stretching strut at the other end. The main extension arm and the minor extension arm are mutually coupled to each other at their middle points. The secondary stretching strut is further pivotally coupled to an extended pivot end of either the minor runner or the top notch of the sunshade or parasol so as to permit the sunshade to be extended in an easier and smoother manner when the main runner is pushed up or pulled down by a user.

3 Claims, 5 Drawing Sheets

COLLAPSIBLE FRAME STRUCTURE OF A SUNSHADE OR PARASOL

BACKGROUND OF THE INVENTION

The present invention relates to an improved collapsible frame structure for use on an outdoor sunshade or parasol which is equipped with a minor extension arm coupled to a main runner of a main mast and a main extension arm in pivotal connection to a top retainer of the main mast at one end and to a lower end of a secondary stretching strut at the other end. The main extension arm and the minor extension arm are mutually coupled to each other at their middle points. The secondary stretching strut can be further pivotally coupled to an extended pivot end of either the minor runner or the top notch of the sunshade or parasol so as to permit the sunshade to be extended in an easier and smoother manner when the main runner is pushed up or pulled down.

Referring to FIG. 1, a conventional collapsible frame structure 1 of a sunshade or parasol is made up of a plurality of supporting ribs 10 respectively in pivotal coupling to a top notch 11 at the top end and sewn to the peripheral edge of the canopy 12 of the sunshade and parasol at the other end. The supporting ribs 10 are pivotally supported by a plurality of stretching ribs 15 which are coupled to a lower runner 13 at one end and connected to a pivot member 14 at the middle of each supporting rib 10 at the upper end. There are a main mast 16 having a main runner 160 slidable thereon, a main extension arm 17 and a minor extension arm 18 that are in cross connection to each other. The main runner 160 is in pivotal engagement with one end of the minor extension arm 18 which is in pivotal connection to the top notch 11. There is a secondary stretching strut 19 having one end in pivotal connection to the main extension arm 17 and the other end in pivotal engagement with one of the stretching ribs 15. Thereby the actuation of the main runner 160 can make the canopy 12 of the sunshade extended or collapsed.

Such a prior art frame structure has following disadvantages in practical operation:

1. The force exerted to the main runner 160 on the main mast 16 is directly transmitted to the secondary stretching strut 19 and one of the stretching ribs 15 linearly and not applied to the minor runner 160, making the opening and collapse of the canopy 12 with more effort wasted in vain.
2. The secondary stretching strut 19 and its associated stretching rib 15 are subject to excessive force when pushed and pulled, resulting in easy deformation of the frame structure in operation.

SUMMARY OF THE INVENTION

The primary object of the present invention is to provide an improved frame structure for use on a sunshade which is equipped with a secondary stretching strut in pivotal connection to either a top notch or a minor runner at one end and in pivotal connection to a the main extension arm at the other end. The secondary stretching strut is pivotally coupled to an extended pivot end of either the minor runner or the top notch so as to permit the sunshade or parasol to be extended or collapsed in an easier and smoother manner.

Another object of the present invention is to provide an improved frame structure which is provided with a secondary stretching strut either coupled to the minor runner or the top notch so as to make the applied force to be kept in a linear direction to prevent the secondary stretching strut and its associated stretching rib from being deformed by improper force.

DETAILED DESCRIPTION OF THE PREFERRED EMBODIMENT

Figure 1:
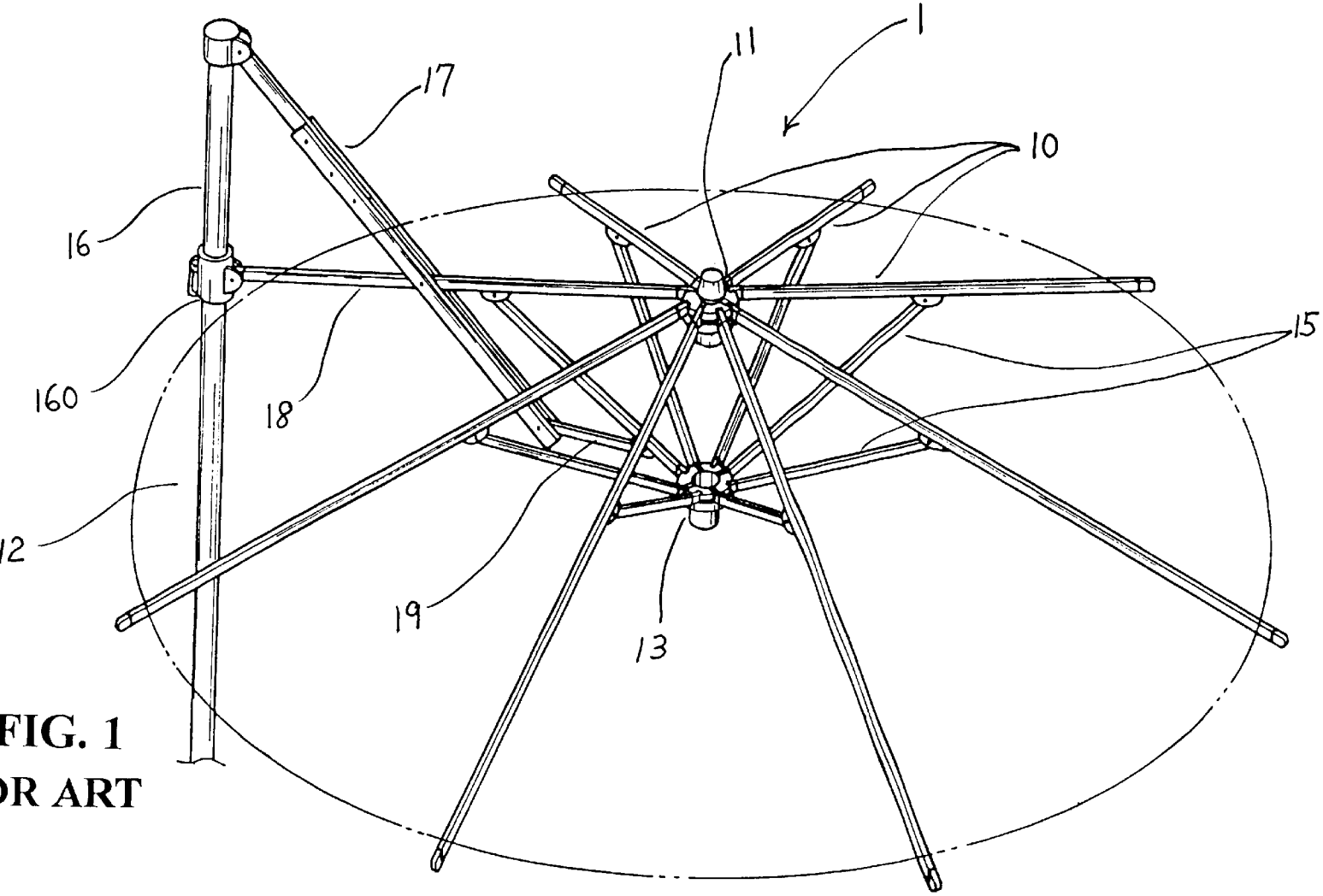
FIG. 1 PRIOR ART
FIG. 1 is a perspective diagram showing a conventional collapsible frame structure of a sunshade or parasol.
Figure 2:
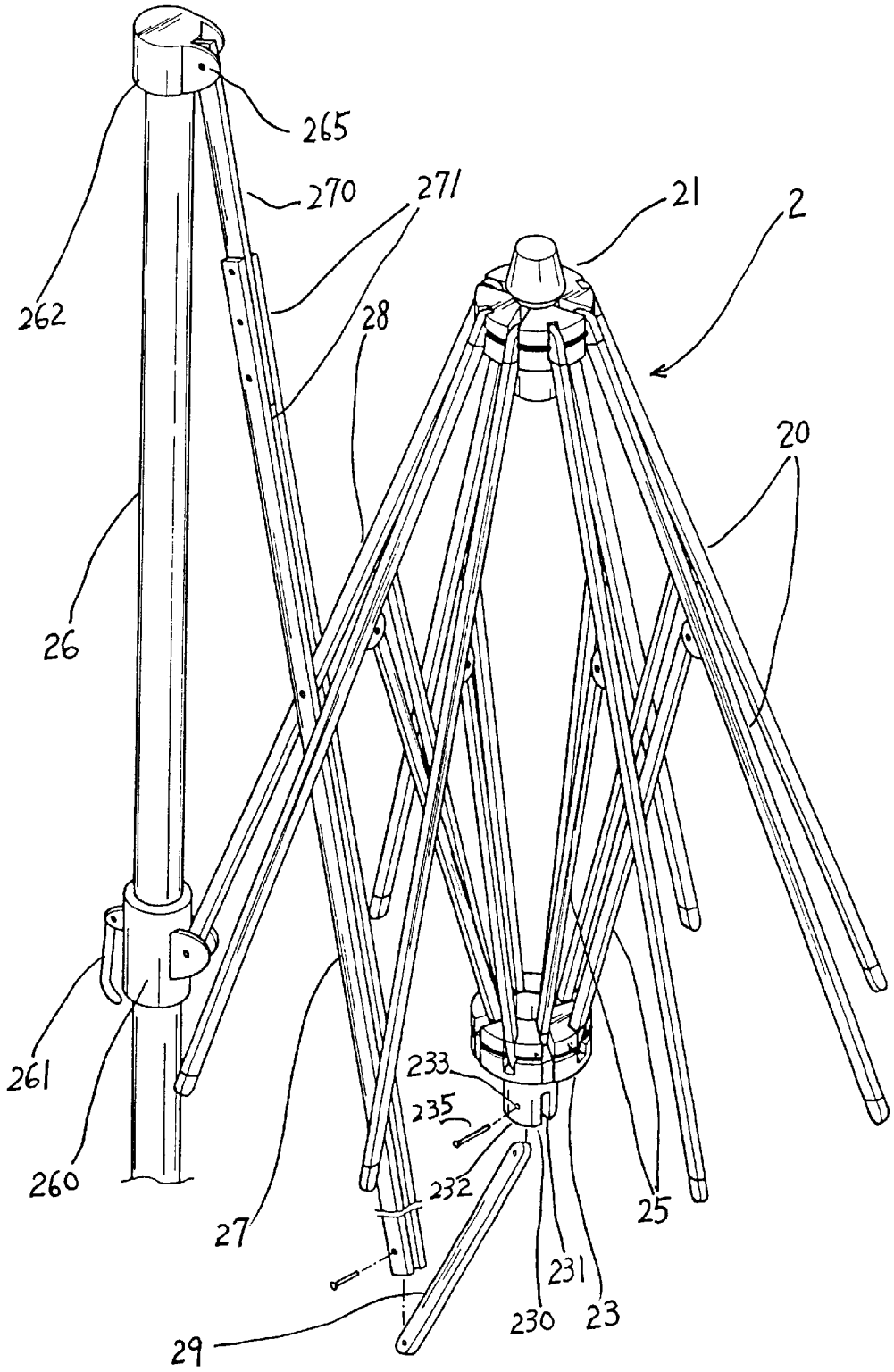
FIG. 2 is a perspective diagram showing the exploded components of the first embodiment of the collapsible frame structure of the present invention.

Referring to FIG. 2, in the first embodiment of the present invention, the frame structure 2 of the present invention is basically identical to the conventional prior art cited in FIG. 1, so the detailed description of the frame structure is not disclosed in the following specification. The collapsible frame structure 2 of the present invention comprises a main mast 26, a main runner 260, a top retainer 262, a main extension arm 27, a secondary stretching strut 29, a plurality of supporting ribs 20, a top notch 21, a plurality of stretching ribs 25, a minor runner 23 and an minor extension arm 28.

The main mast 26 is equipped with the slidable main runner 260 having a retaining pry handle 261 for locking the main runner 260 in position on the mast 26 when the frame structure 2 of the sunshade or parasol is extended. At the top end of the main mast 26 is disposed a top retainer 262 with which one end of the main extension arm 27 is in pivotal engagement.

The main runner 260 is pivotally connected to one end of the minor extension arm 28. The main extension arm 27 and the minor extension arm 28 are in cross and pivotal engagement with each other. The other end of the minor extension arm 28 is in pivotal connection to the top notch 21 of the sunshade.

The main extension arm 27 is a rod 270 with two parallel elongated flat plates 271 secured to one end and is in pivotal registration with the top retainer 262 at the other end so as to permit the minor extension arm 28 guided via the space defined between the two flat plates 271 of the main extension arm 27 to be in cross engagement with the main extension arm 27.

In the same way disclosed in the prior art frame structure, the supporting ribs 20 of the present invention are collapsibly or pivotally secured to the top notch 21 at their top ends and their bottom ends are sewn to the periphery of the sunshade canopy or cover 22. The stretching ribs 25 are in pivotal connection to the middle of the supporting ribs 20 at their top ends respectively and also in pivotal engagement with the mirror runner 23. The minor extension arm 28 is cross connection to the main extension arm 27 is also pivotally coupled to the top notch 21 of the sunshade at one end and to the main runner 260 of the main mast 26 at the other end. The main extension arm 27 is in pivotal connection to a pivot member 265 of the top retainer 262 of the main mast 26 at one end.

Figure 3:
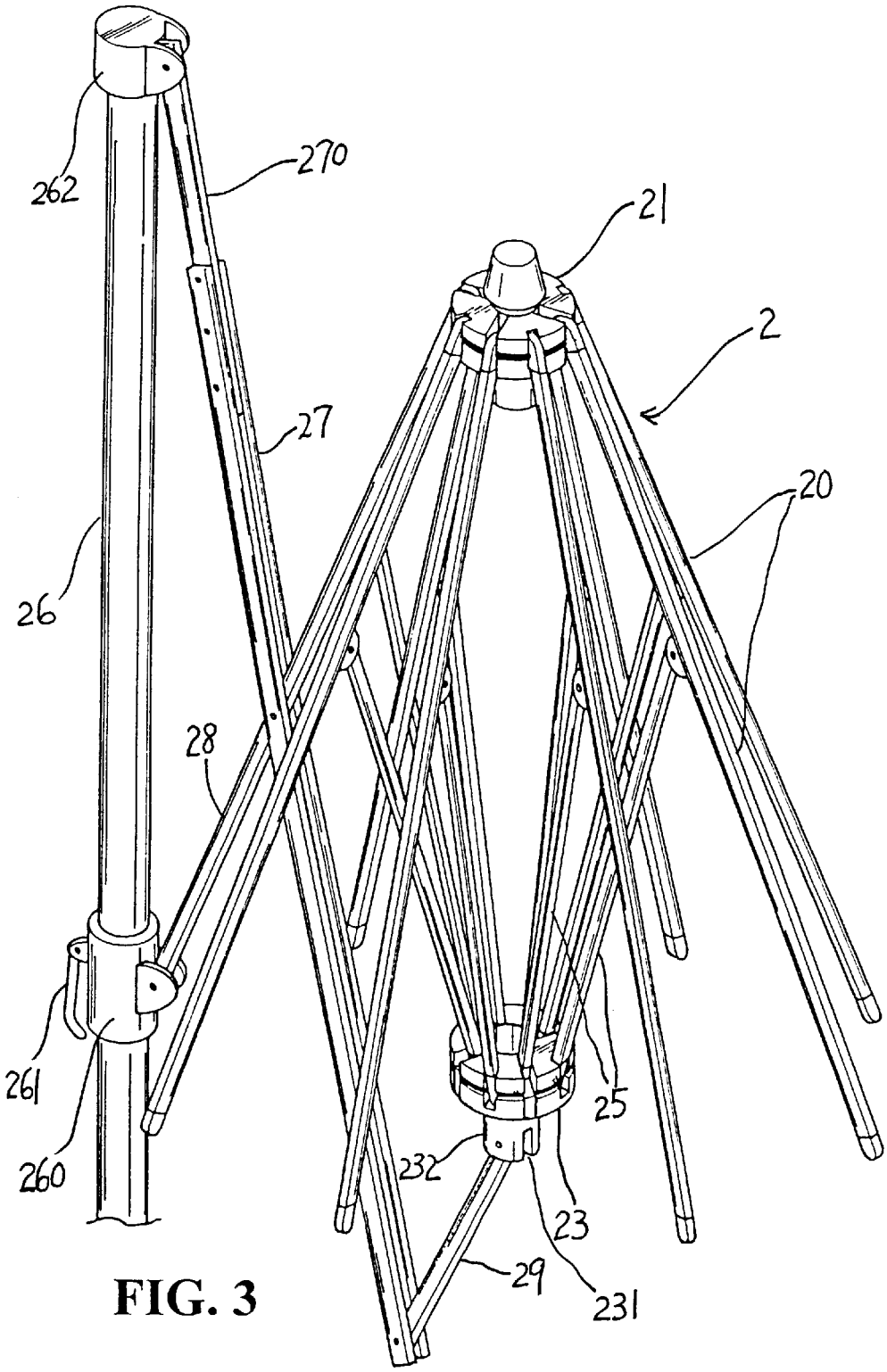
FIG. 3 is a perspective diagram showing the assembly of the first embodiment thereof.

In the first embodiment of the present invention, as shown in FIG. 2, the minor runner 23 is additionally provided with a groove 231 on the downwardly extended tube 230, defining a pair of opposite lugs 232 thereon. A pin hole 233 is defined on each lug 232 so as to permit a pivot pin 235 to be guided therethrough. A secondary stretching strut 29 having one through hole at each end is connected to the groove 231 of the minor runner 23 at one end and is in pivotal registration with the end opposite to the end in pivotal engagement with the top retainer 262 of the main mast 26. As shown in FIG. 3, as the main runner 260 is pushed upwardly, the minor extension arm 28 will be forced to extend horizontally to lift the top notch 21 of the frame 2 upwardly, resulting in the main extension arm 27 in cross and pivotal engagement with the minor extension arm 28 being simultaneously pivoted away from the main mast 26. Accordingly, the secondary stretching strut 29 having one end in pivotal connection to the main extension arm 27 and another end in pivotal registration with the minor runner 23 will be simultaneously lifted up.

Figure 4:
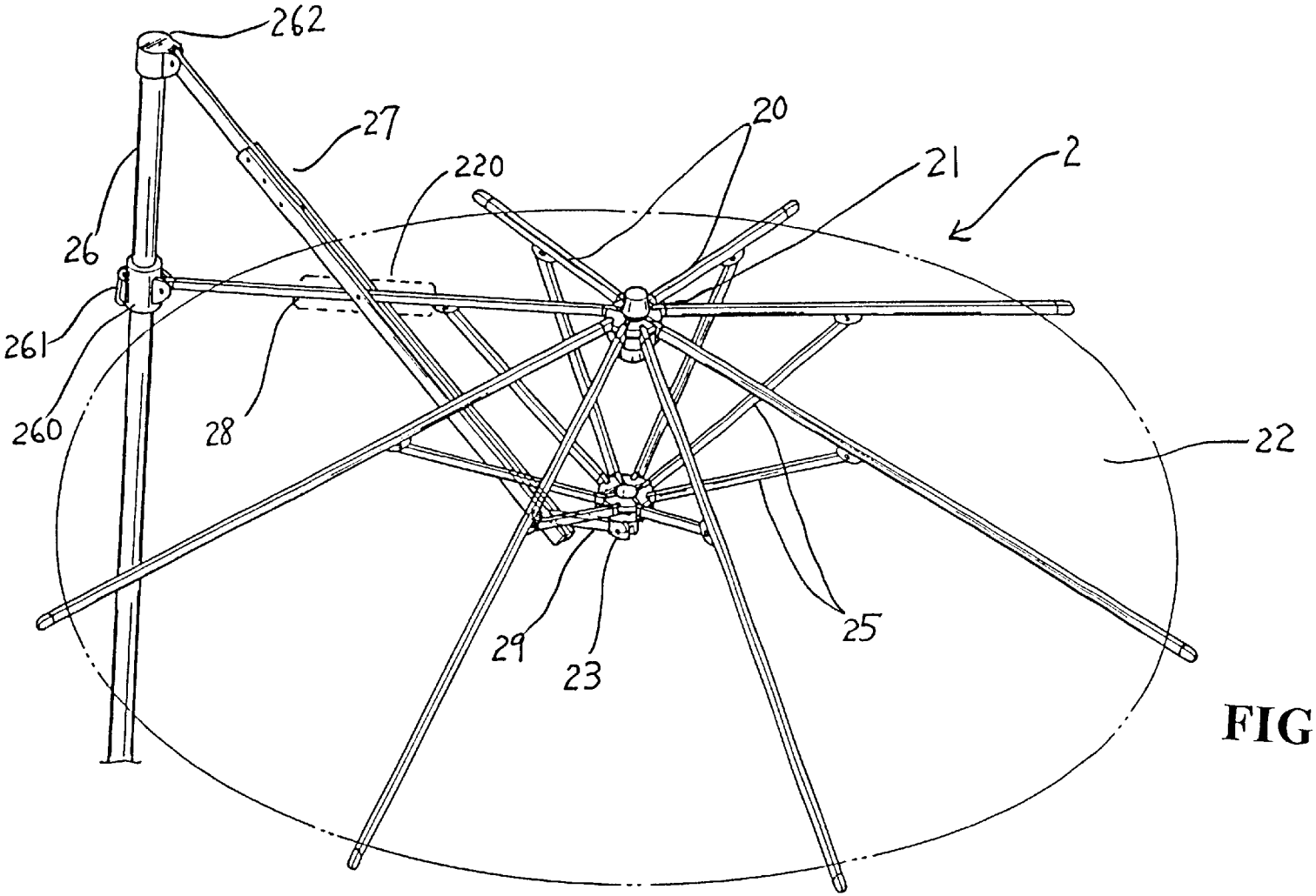
FIG. 4 is a perspective diagram showing operation mode of the first embodiment thereof.

Referring further to FIG. 4, the assembly of the sunshade with a cover (shown in a dotted line) is illustrated. Take notice that most portions of the main extension arm 27 and the minor extension arm 28 are located under the cover or canopy of the sunshade, and only a small portion of the main and minor extension arm 27, 28 are externally exposed. The cover or canopy 22 of the sunshade must be equipped with an opening 220 for the passage of the main extension arm 27 and the minor extension arm 28 partially so as to permit the frame of the sunshade to open and collapse without interference. Since the sunshade or parasol of the present invention is mainly used on beaches and in gardens for sheltering sun gleams, the opening 220 will not spoil the normal function of the same.

Figure 5:
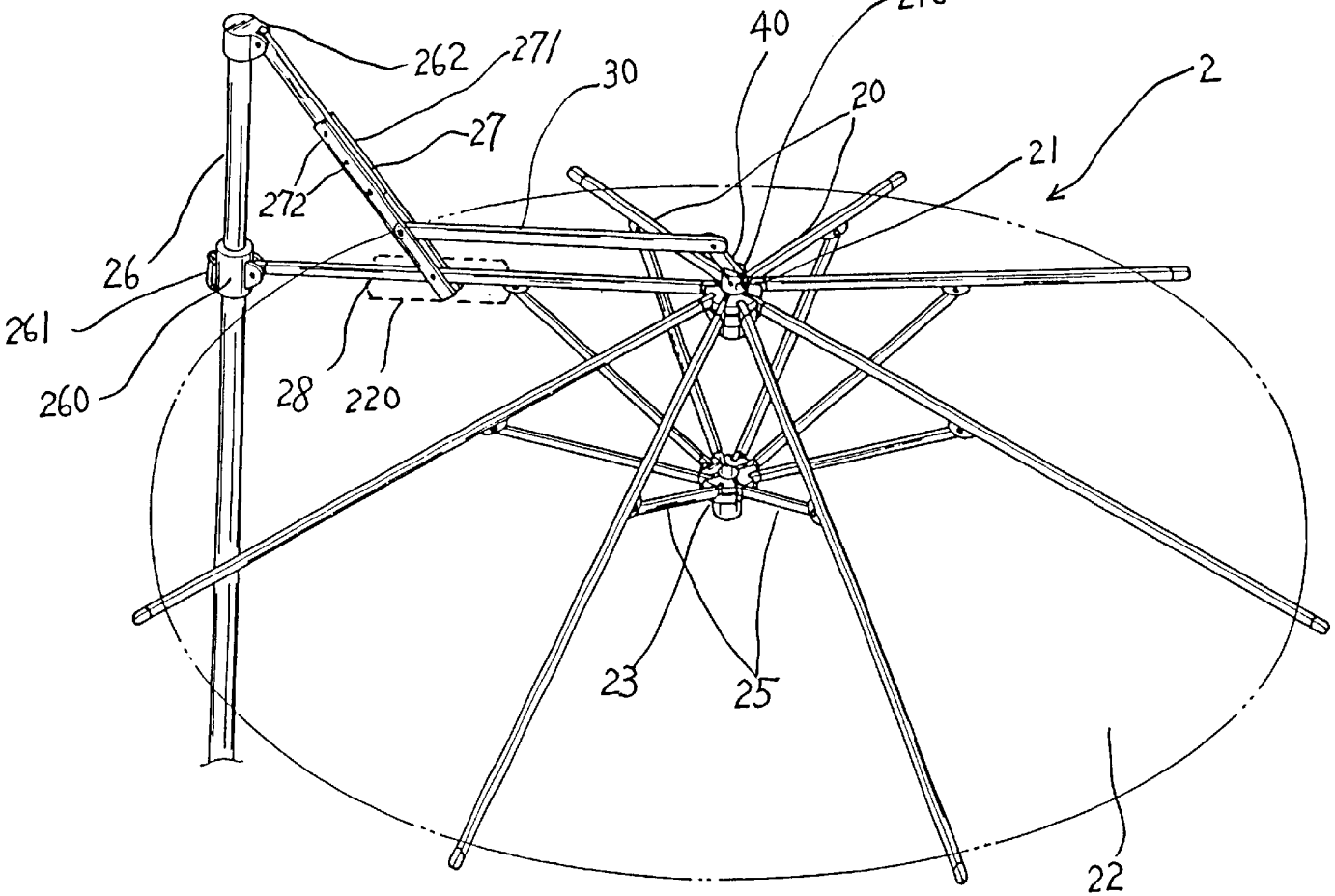
FIG. 5 is a perspective diagram showing the second embodiment of the present invention.

As further shown in FIG. 5, in the second embodiment of the present invention, the minor runner 23 is not modified and is identical in structure to the runner 13 disclosed in the prior art illustrated in FIG. 1. The main extension arm 27 is shorter in length than the arm shown in the first embodiment and is directly in pivotal connection to the minor extension arm 28 at one end. There are a plurality of pin holes 272 are disposed on the two parallel flat plates 271. A secondary stretching strut 30 is pivotally engaged with the main extension arm 27 at one end and is in pivotal connection to a linkage arm 40 which is coupled to a pivot mount 210 extended from the top notch 21 of the sunshade. The main extension arm 27 is in parallel with the linkage arm 40 and the secondary stretching strut 30 is parallel with the minor extension arm 28 as the main runner 260 is pushed downwardly, i.e. they are kept in a parallelogram in shape. In operation, the main runner 260 is pushed to slide upwardly along the main mast 26 to make the minor extension arm 28 to extend the same into a horizontal position with the main extension arm 27 pivoted away from the main mast 26. Simultaneously, the secondary stretching strut 30 is guided into a parallel position with respect to the minor extension arm 28 with the linkage arm 40 parallel with the main extension arm 27. Accordingly, the linkage arm 40 will lift the top notch 21 of the sunshade frame 2, causing the supporting ribs 20 to pivot horizontally so as to get the canopy 22 of the sunshade opened. To get the canopy 22 collapsed, the main runner 260 is pushed downwardly to cause the main and minor extension arms 27, 28 pivoted toward the main mast 26.

In summary, the present invention intends to place the secondary stretching strut 30 in direct engagement either with the minor runner 23 or the top notch 21 so as to make the force of extension of the frame structure 2 as a result of the upward push of the main runner 260 more in alignment with the central line defined between the top notch 21 and the minor runner 23. Thus, a user can apply less force to get the frame structure 2 extended or collapsed in a more smooth manner in one aspect and the frame structure 2 can be effectively protected from easy damage or disfiguration in frequent operations.

I claim:

1. A collapsible frame structure of a sunshade or parasol, comprising:

a main mast having a top retainer disposed at a top end thereof and a slideable main runner mounted thereto;

a main extension arm having one end in pivotal connection to said top retainer;

a minor extension arm being in pivotal coupling to said main runner at one end thereof;

said main extension arm and said minor extension arm being in cross and pivotal engagement with each other;

a top notch disposed at the summit of the frame structure;

a minor runner placed vertically in linear alignment with said top notch;

a plurality of supporting ribs respectively having one end thereof in pivotal connection to said top notch;

a plurality of stretching ribs each having one end in pivotal connection to said minor runner and the other end in pivotal coupling to a middle position of each said supporting rib;

wherein said minor runner is additionally equipped with a pivot means so as to permit a secondary stretching strut to be in pivotal connection to said pivot means at one end and in pivotal coupling to an end of said main extension arm opposite to said end in pivotal connection to said main mast whereby a force applied to said main runner to push the same upwardly or downwardly can be transmitted to said minor runner in a smoother and more direct manner.

2. A collapsible frame structure of a sunshade or parasol, comprising:

a main mast having a top retainer disposed at a top end thereof and a slideabie main runner mounted thereto;

a main extension arm having one end in pivotal connection to said top retainer;

a minor extension arm being in pivotal coupling to said main runner at one end thereof;

said main extension arm and said minor extension arm being in cross and pivotal engagement with each other;

a top notch disposed at the summit of the frame structure;

a minor runner placed in linear alignment with said top notch;

a plurality of supporting ribs respectively having one end thereof in pivotal connection to said top notch;

a plurality of stretching ribs each having one end in pivotal connection to said minor runner and the other end in pivotal coupling to a middle position of each said supporting rib;

wherein said top notch is additionally equipped with a pivot means so as to permit a linkage arm to be in pivotal connection to said pivot means at one end and in pivotal coupling to an end of a secondary stretching strut which is in pivotal connection to a point of said main extension arm between two ends thereof whereby a force applied to said main runner to push the same upwardly or downwardly can be transmitted to said minor runner in a smoother and more direct manner.

3. The collapsible frame structure of a sunshade or parasol as claimed in claim 2 wherein said linkage arm, said secondary stretching strut, said main extension arm and said minor extension arm are in parallelogram shape when said frame structure is fully extended.

* * * * *